US005531159A

United States Patent [19]

Stubblefield

[11] Patent Number: 5,531,159

[45] Date of Patent: Jul. 2, 1996

[54] PULL-OUT DROP DOWN SHELF STRUCTURE

[75] Inventor: Reggie W. Stubblefield, Garland, Tex.

[73] Assignee: Universal Display & Fixtures Company, Garland, Tex.

[21] Appl. No.: 293,880

[22] Filed: Aug. 19, 1994

[51] Int. Cl.[6] ..... A47B 11/00

[52] U.S. Cl. ..... 108/102; 108/108; 248/242

[58] Field of Search ..... 108/102, 109, 108/108, 73, 75, 143; 248/240, 242, 298; 211/150, 151, 59.2

[56] References Cited

U.S. PATENT DOCUMENTS

| | | | |
|---|---|---|---|
| 1,702,937 | 2/1929 | Friedemann | 248/242 X |
| 3,463,433 | 8/1969 | Stein et al. . | |
| 3,561,713 | 2/1971 | Berkowitz . | |
| 3,795,379 | 3/1974 | Gray . | |
| 4,343,244 | 8/1982 | Moriarty et al. . | |
| 4,589,349 | 5/1986 | Gebhardt et al. | 108/102 |
| 4,602,570 | 7/1986 | Lee | 211/150 X |
| 4,620,489 | 11/1986 | Albano | 108/105 |
| 4,776,472 | 10/1988 | Rosen | 211/150 X |
| 4,934,645 | 6/1990 | Breslow | 108/108 X |
| 5,199,579 | 4/1993 | Van Duyne . | |

*Primary Examiner*—Jose V. Chen
*Attorney, Agent, or Firm*—Harris, Tucker & Hardin

[57] ABSTRACT

A pull-out drop down grocery shelf structure has slotted sliding brackets and stationary brackets. A shelf is fixed at each side to a sliding bracket which is slidingly supported on a stationary bracket. The stationary brackets project outwardly from wail supports. The shelf can be pulled out, pivoted down at an angle and supported by connectors which slide in the respective slots of the two brackets so that the product displayed can be pulled forward without disturbing the arrangement. Fresher product can be stocked behind the older product without unloading the shelf. The shelf is pivoted up and slid back against the wall after fresh product is stocked on the shelf. Both brackets can be economically stamped from fiat stock and employed universally as a left or fight side bracket for a shelf without any change to the bracket or its assembly.

16 Claims, 4 Drawing Sheets

PULL-OUT DROP DOWN SHELF STRUCTURE

BACKGROUND OF THE INVENTION

1. Field of the Invention

The invention lies in the field of grocery shelves, more particularly pull-out shelf supports for a shelf which pulls out and drops down to facilitate loading fresh products at the back of the shelf without unloading products already on the shelf.

2. Background of the Prior Art

Grocery shelves are erected along vertical walls which define the aisles of a store. The shelves are supported in a horizontal position perpendicular to the wall surface by brackets which are usually placed at each side edge of rectangular shelves. The brackets generally have a back end having hook formations and the wall generally has spaced apart upright standards having a series of vertically arranged slots which receive the hooked formations in any number of elevations depending upon which slots are chosen. The shelves are located at a plurality of elevations such that there is a vertical space between the shelf surfaces to provide the desired amount of vertical product space. The shelves are frequently wire mesh shelves with a turned-up outer front edge which helps keep product from sliding off.

A particular problem arises in the restocking of snack products, such as bags of potato chips, tortilla chips, popcorn, pretzels and the like. In order to prevent waste, it is incumbent upon the snack food supplier to make sure fresher product being stocked is placed at the rear of the shelf so that older, already-stocked snack product is sold first. Many of these products are dated and generally have a very short shelf life before staleness becomes apparent.

Prior art shelves are typically four feet wide and mounted adjacently at a selected elevation. They necessitate unloading the old product from the shelf, placing the fresh product in the back, and then replacing the previously stocked older product in the front of each shelf. Since the route man usually fills these shelves, he must visit many stores on his route in a limited amount of time, and there is a lot of wasted time in loading and unloading shelves to make sure the older product is sold first. There are prior art shelves which pull out, but they are not typically used in grocery stores, and even if they were, the snack products are typically sold in tall bags which fall over easily in any direction without support. The route man cannot control these bags with his arms and still reach the fresh product to restock. Apart from using two route men, one to pull the bags forward while the other restocks fresh bags in the back, there is no suitable prior art solution to this problem, and the use of two route men is not economically feasible.

SUMMARY OF THE INVENTION

A pull-out drop down support structure is disclosed which permits grocery shelves to be pulled out and dropped down where they are held at an angle to facilitate restocking. The older products are brought to a forward position where they are held against a temporary "fence" at the front which keeps them from falling off while fresher product is placed at the back of the shelf. One man can restock the shelf, without altering the arrangement of the products already on the shelves, since once the shelf is pulled out and tilted down, the bags remain in place under the influence of their weight. The route man is then free to use both hands to stock fresh bags quickly while keeping the display looking orderly and without the need for a substantial rearranging of the bags of product already on the shelf. When the shelf is restocked, it is tilted back up to a level horizontal position and slowly slid back and retracted into the display position. The shelf may have some raised portion or horizontal wires running along above the back edge to keep bags from falling off the back and to aid in stocking the bags on the shelf.

The opposite sides of the shelf are fixed to a sliding bracket which is mounted on a stationary bracket comprising an elongated panel having a back end adapted for removable attachment to the slotted openings in standard upright connectors spaced apart along a wall surface by the width of the shelf. The stationary bracket has a length and a front end projecting longitudinally outwardly when the back end is attached to a wall. An elongated slot extends longitudinally from front to back along the length of the stationary bracket.

The sliding bracket comprises an elongated panel arranged as a companion to the stationary bracket in side by side relation. The sliding bracket has a length, a front end and a back end and an elongated slot extending longitudinally from front to back along its length. The elongated slots in each of the stationary and sliding brackets have a front end and a back end located proximate to the front and back end of the respective stationary or sliding bracket in which they are formed.

A first connecting support fixed near the back end of the sliding bracket slides in the elongated slot of the stationary bracket. A second connecting support fixed near the front end of the stationary bracket slides in the elongated slot of the sliding bracket. The sliding bracket can be moved longitudinally relative to the stationary bracket between a retracted and an outwardly extended position.

There is a means associated with an end of one of the elongated slots to allow the sliding bracket to be pivoted downwardly, tilted at an angle and supported with respect to the stationary bracket when the sliding bracket is pulled out to its extended position and dropped down. The operation is reversible by lifting the downwardly angled sliding bracket back to the horizontal position by lifting the outer edge of the shelf upwardly and then pushing the shelf back to cause the sliding bracket to move to the retracted position. The connecting supports are designed to hold the stationary bracket and sliding bracket in mutual support in close sliding relation to each other. The connecting supports also function as stops to limit the maximum outward extension of the shelf. One of them acts as a pivot around which the shelf pivots downwardly and the other supports the shelf in the downwardly pivoted position.

In one embodiment, the means associated with an end of one of the elongated slots is associated with the back end of the elongated slot in the sliding bracket. It comprises a generally transverse extension of the elongated slot in the sliding bracket which is occupied by the second connecting support of the extended sliding bracket when angled downward from the longitudinal horizontal position of the stationary bracket. The generally transverse extension of the elongated slot in the sliding bracket is preferably an arcuate slot formed on a radius defined in the extended position by the distance between the first and second connecting supports wherein the first connecting support serves as a stop and a pivot for the sliding bracket when it is pulled out to the extended position and pivoted downwardly.

In a further embodiment, the means associated with the end of one of the elongated slots is associated with the front end of the elongated slot in the stationary bracket and is a generally transverse extension of the elongated slot of the stationary bracket which is occupied by the first connecting support when the sliding bracket is moved to the extended position and angled downwardly from the longitudinal horizontal position of the stationary bracket. The said means associated with the front end of the elongated slot of the stationary bracket is preferably a short arcuate slot formed on a radius defined in the extended position by the distance between the first and second connecting supports wherein the second connecting support serves as a stop and a pivot for the sliding bracket, when it is pulled out to the extended position and pivoted downwardly.

The outer end of the slot in the sliding bracket has an upwardly angled portion which is referred to as a second rest in the sliding bracket which receives the second connecting support when the sliding bracket is retracted all the way back. The second rest serves as a lock which prevents pulling the shelf out unless the sliding bracket is first raised to clear the rest. The inner end of the slot in the stationary bracket has a downwardly angled continuation which is called a first rest which receives the first connecting support when the shelf is pushed back and locked by means of the second rest and second connecting support. This first rest is placed so that the inner end of the sliding bracket is lowered the same amount as the outer end of the sliding bracket to keep the shelf level and help to retain it in the retracted position.

The improved shelf support emphasizes economy of manufacture and minimizes inventory and assembly problems. The universal shelf bracket is made from flat stock which can be formed in a stamping operation. It only requires two stamped brackets and two connectors and is universal in that it can be used as the left and right shelf support without altering either the parts or the assembly of the parts. One universal support bracket is used to support either side of a shelf. This reduces inventory and prevents mistakes when putting the shelves up.

The back end of the stationary bracket is preferably formed with short lateral formations which project laterally on either side to add lateral stability. Lengthy lateral formations projecting laterally from the side surface of both the sliding and stationary bracket may be used to increase strength. The lower edge of the stationary bracket may be bent at right angle to the side surface to add bending resistance without interfering with the sliding action of the brackets.

DETAILED DESCRIPTION

Figure 4:
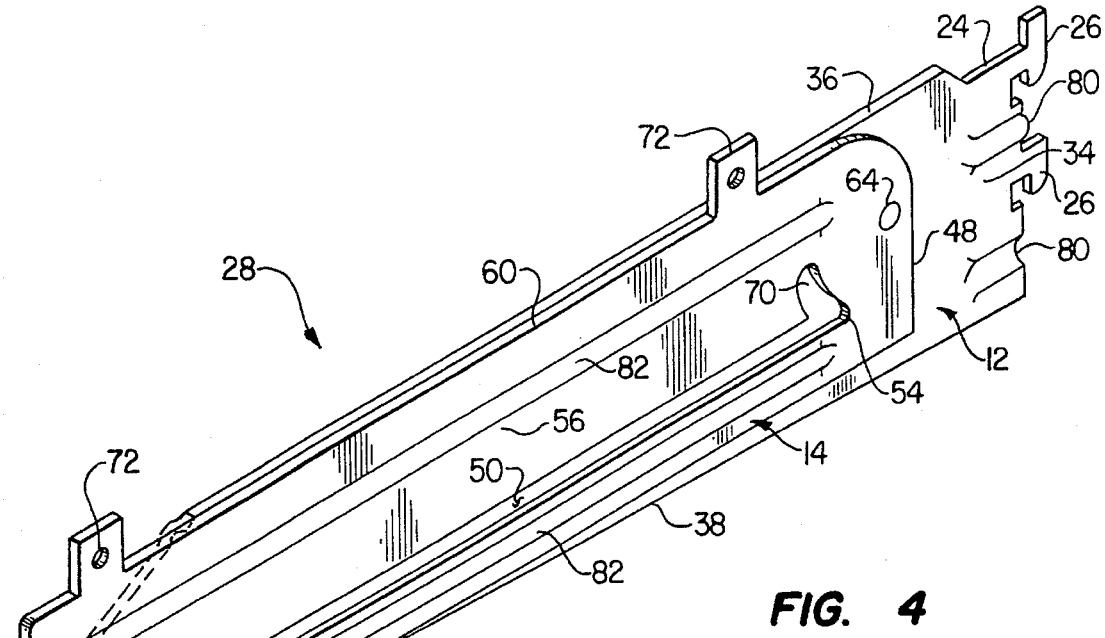
FIG. 4 is a perspective view of one side of the pull-out drop down shelf support or universal support bracket with added strengthening elements in the retracted position.
Figure 5:
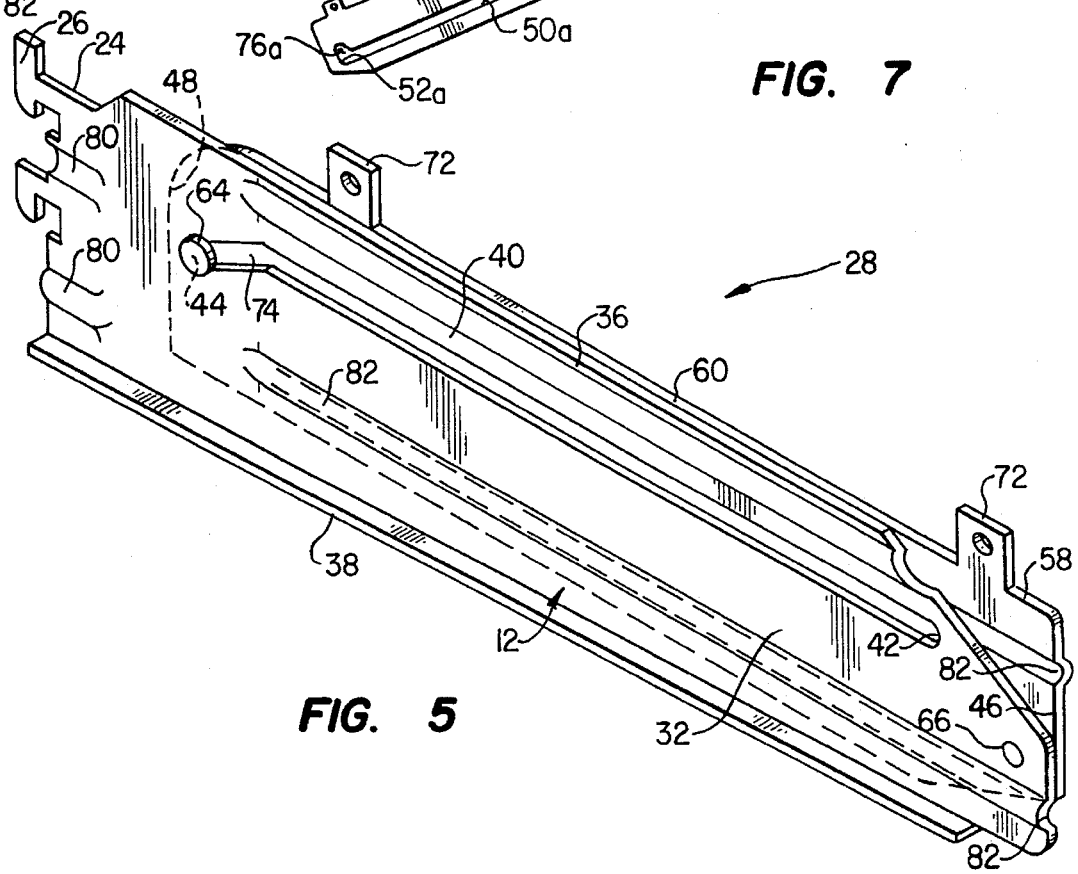
FIG. 5 is a view of the shelf support on FIG. 4 showing the opposite side from the side shown in FIG. 4.

In the description which follows, the same reference numerals will be used throughout to identify corresponding parts. FIGS. 4 and 5 differ in appearance from the brackets shown in the other Figures because they include strengthening formations and a bent over lower edge on the stationary bracket that do not interfere with sliding extension or retraction of the sliding bracket. Nevertheless, these parts will carry the same reference numerals as the corresponding parts in the other Figures because the invention will be easier to comprehend. It will be understood that these strengthening features could be visualized as preferably being present in the brackets of the other Figures but if shown in the smaller drawings, would unnecessarily complicate the drawings.

Figure 3:
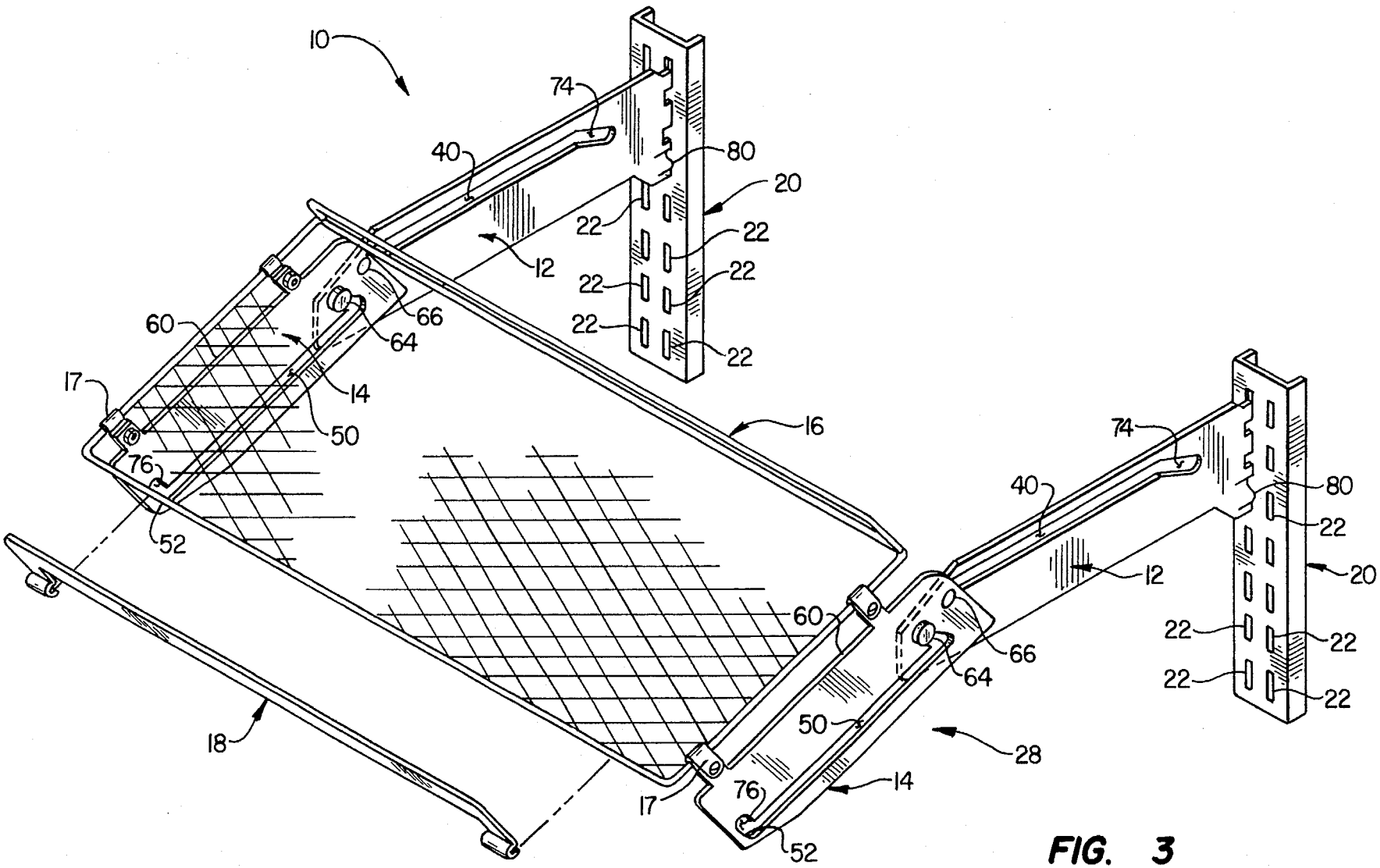
FIG. 3 is a perspective view showing a pair of the universal support brackets with a sliding bracket mounted to the opposite side edges of a standard grocery shelf wherein the brackets have been moved to the extended position and tilted downwardly where they are held by interaction of the connectors in the slots.

Referring now to the drawings, FIG. 3 shows a pair of pull-out drop down shelf supports in support of a conventional grocery shelf which has been pulled out and dropped down from a horizontal position to a downwardly angled or tilted position and generally designated by the reference numeral 10. The pull-out drop down shelf supports will be referred to as universal support brackets because the same brackets can be used for a left or right side shelf support.

The shelf support structure includes a pair of stationary brackets 12 each having a companion sliding bracket 14. The opposite sides of a grocery shelf 16 are mounted on sliding brackets 14. A removable fence 18 removably fits the front edge of grocery shelf 16. Conventional grocery shelves normally have upturned front edge (not shown) such that fence 18 would extend the height of the front of shelf 16. Wall supports 20 are conventional supports which are fixed to a wall surface, spaced apart with the longitudinal axis vertical. Wall supports 20 have double rows of side-by-side slots 22. Stationary brackets 12 are removably supported in horizontal and vertical orientation perpendicular to wall supports 20. The back 19 of shelf 16 may be turned up or elevated to help hold bags of product on the shelf.

Figures 1, 2:
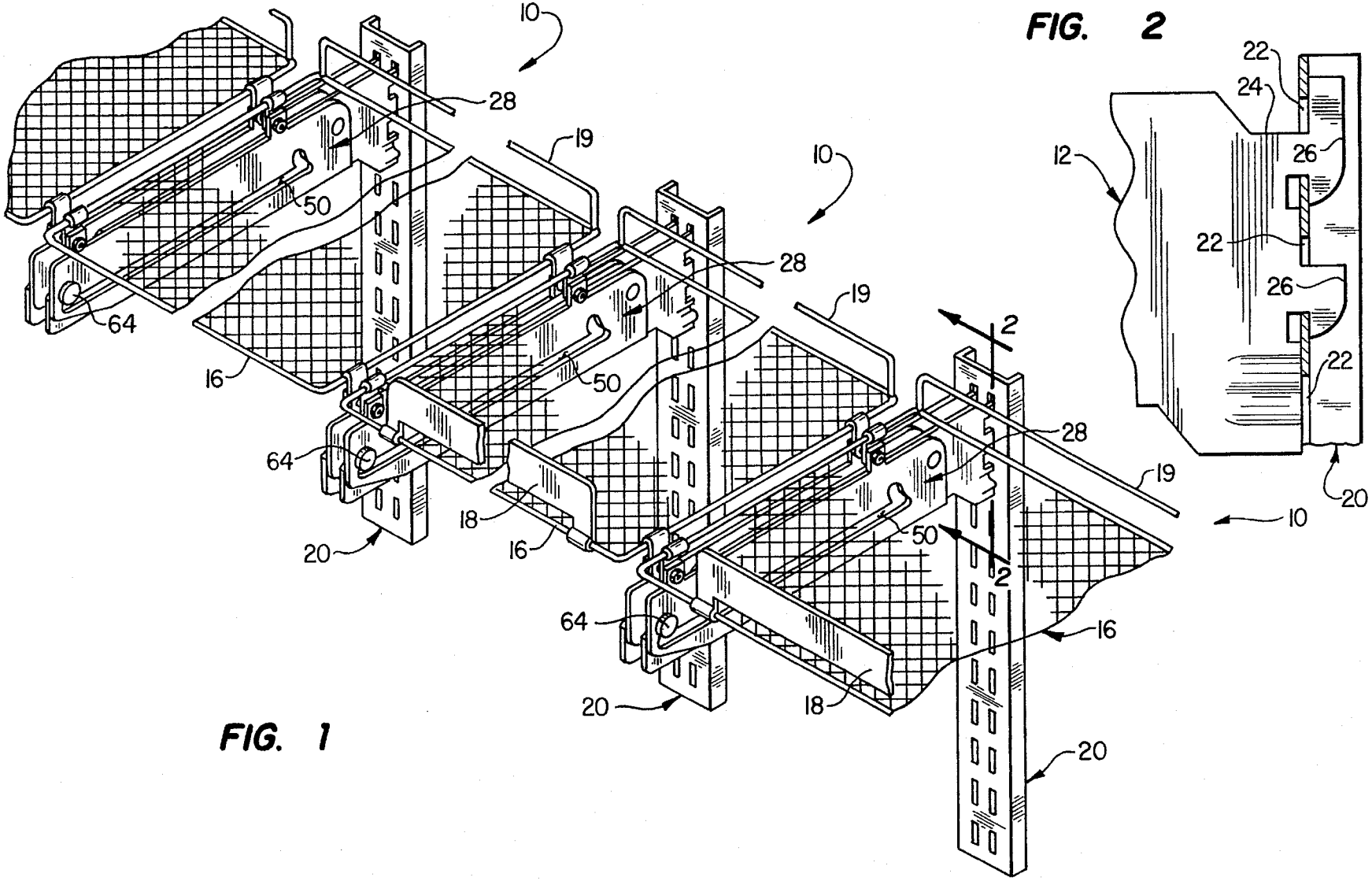
FIG. 1 is a cut-away perspective view of several side by side grocery shelves, each having opposite sides mounted on a sliding bracket.
FIG. 2 is a detail in elevation cross-section of the conventional upright slotted support showing how the back of the stationary bracket has formations for engaging the support and capable of holding it in a horizontal orientation with the sides vertical.

Referring now to FIG. 2, stationary brackets 12 have a back portion 24 having formations 26 which fit slots 22 of wall supports 20 and thereby hold brackets 12 in the desired horizontal position in vertical orientation.

FIG. 1 shows a plurality of adjacent pull-out drop down grocery shelf assemblies 10 each having a pair of universal support brackets which will be referred to generally as universal support brackets 28 comprising the combination of a stationary bracket 12 and a sliding bracket 14. As will be seen, the universal support brackets can be used interchangeably as a left side support or a fight side support for a shelf 16.

Turning now to FIGS. 4 to 7, universal shelf bracket 28 comprises stationary bracket 12 and sliding bracket 14. Stationary bracket 12 has a back 24 with the formations 26 for attachment to the wall support 20. Bracket 12 has a front 30 and generally flat sides 32 and 34. It is preferably stamped out of a flat sheet. The stationary bracket 12 may have short lateral formations 80 which project laterally from back portion 24 to interact with the surface of wall supports 20 thereby increasing lateral stability. The stationary bracket 12 and the sliding bracket 14 may have one or more elongated lateral formations 82 along the flat surface to add strength to the thin flat sections. The sides 32, 34 of the stationary bracket define a top edge 36 and a bottom edge 38. Bottom edge 38 may be bent at a right angle to the side surface to provide additional bending strength. Stationary bracket 12 has an elongated slot 40 extending longitudinally from front to back along its length. Slot 40 has an outer end 42 and an opposite inner end 44.

The sliding bracket 14 has a front 46, a back 48 an elongated slot 50 extending longitudinally from front to back along its length. Slot 50 has an outer end 52 and an inner end 54. Sliding bracket 14 has generally flat sides 56 and 58 defining a top edge 60 and a bottom edge 62. One or more means for connecting comprise raised tabs 72 spaced along the top edge 60 for connecting each side of a shelf 16 to the sliding bracket. Any suitable connectors 17 can be used to attach the shelf 16 to the tabs 72.

Each universal support bracket 28 has a first connector 64 otherwise referred to as a first connecting support 64, fixed near the back of the sliding bracket 14. Connecting support 64 slides in elongated slot 40 of stationary bracket 12. A second connector 66 otherwise known as a second connecting support is fixed near the front of the fixed bracket which slides in elongated slot 50 of sliding bracket 14. First and second connectors 64, 66 have a short stem portion which is hidden in all views with a headed portion which is wider than the slot 40, 50. The hidden stem portions are narrower than slots 40, 50 to avoid binding and serve as a gliding surface to facilitate relative sliding movement between brackets 12, 14. The headed connectors 64 and 66 are the only thing holding brackets 12, 14 in sliding side by side relation whereby sliding bracket 14 can be moved longitudinally with respect to the stationary bracket between a retracted position shown in FIGS. 4 and 5 and an extended position seen in FIGS. 6C and 6D. Elongated slots 40, 50 are preferably offset vertically from each other to simplify layout and assembly and reduce the possibility of interference.

Figure 6A:
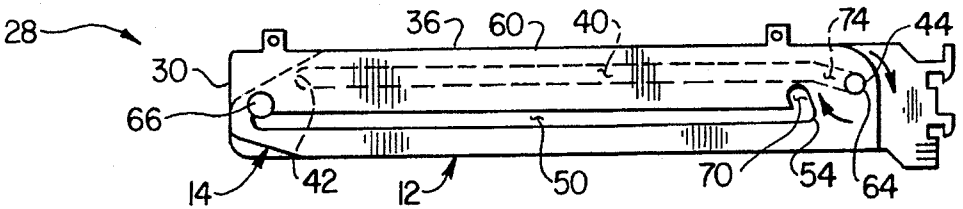
FIG. 6A schematically shows a universal support bracket in the retracted position.
Figure 6B:
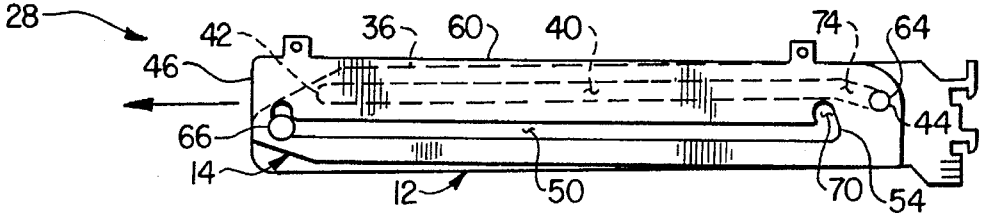
FIG. 6B schematically shows the bracket of FIG. 6A being readied for sliding toward the extended position in the direction of the arrow.
Figure 6C:
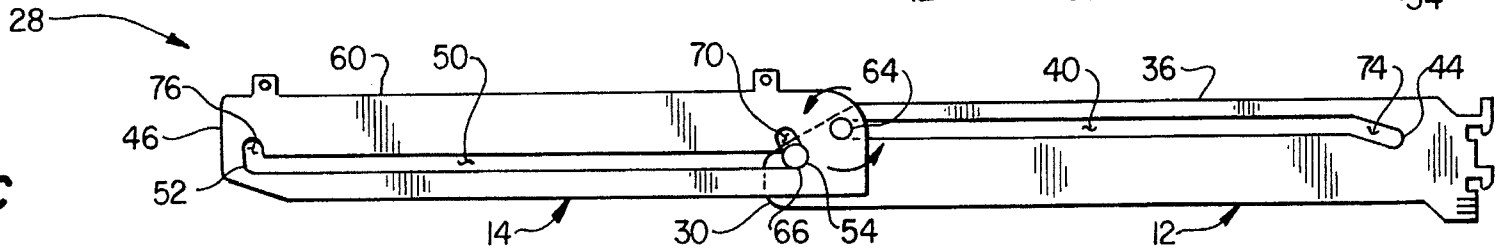
FIG. 6C schematically shows the shelf support in the fully extended position before the sliding bracket is angled downwardly.
Figure 6D:
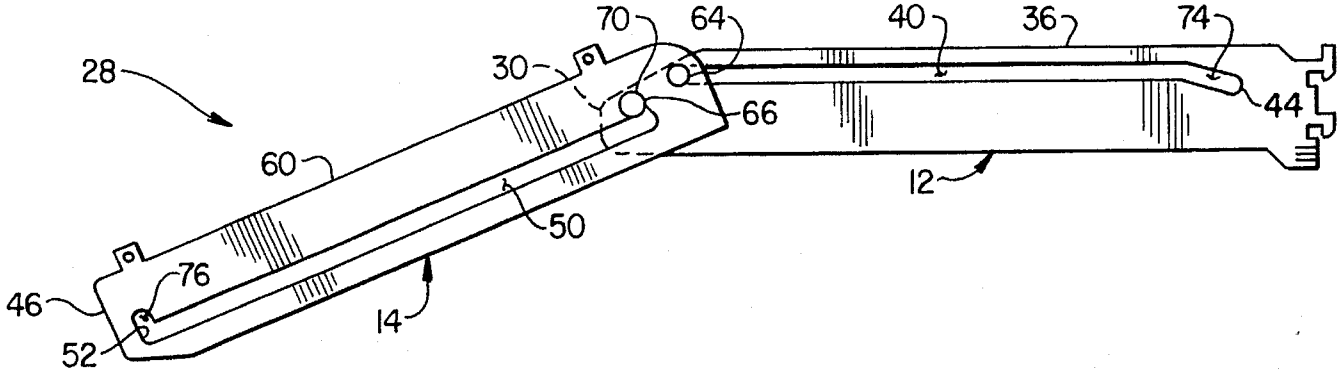
FIG. 6D schematically shows the sliding bracket in the extended and downwardly angled position where it is held by cooperation of the first and second connecting supports positioned as shown in the elongated slots.

There is provided a means associated with an end of one of the elongated slots in each universal support bracket 28 to allow sliding bracket 14 to be pulled out to its extended position along with a shelf 16, pivoted downwardly and supported there at an angle with respect to the stationary bracket 12 as illustrated in FIG. 3 and 6D. In the embodiment shown in FIG. 4, said means is associated with inner end 54 of slot 50 as a generally transverse extension 70 of slot 50 which extends toward top edge 60. In the preferred embodiment, slot 70 is an arcuate slot formed on a radius defined in the extended position by the distance between first connecting support 64 and second connecting support 66 wherein first connecting support 64 serves as a stop for sliding bracket 14 and also as a pivot for sliding bracket 14 when it is pulled out to the extended position and pivoted downwardly.

The back of the elongated slot in the stationary bracket comprises a first rest 74 which turns away from the top edge 36 and is angled downwardly from the longitudinal axis of slot 40. Referring now to FIG. 3, a second rest 76 is formed at the front end 52 of elongated slot 50 in the sliding bracket. Second rest 76 turns up toward the top edge 60 of the sliding bracket.

When the universal support bracket 28 is in the retracted position best seen in FIG. 6A, the first rest 74 receives the first connecting support 64 and the second rest 76 receives the second connecting support 66. The front end 46 of the sliding bracket drops down so that the stem of second connecting support 66 serves as a lock which keep the sliding bracket from being pulled out. Simultaneously first rest 74 lowers back end 48 of sliding bracket 14 so that in the retracted position, the sliding bracket remains horizontal and the top edge 60 parallel to the top edge 36 if the brackets are constructed as generally rectangular shapes as they are shown in the drawings. This serves to keep the shelf 16 completely level.

The operation of universal support bracket 28 is best seen through FIGS. 6A–6D. In FIG. 6A, universal support bracket 28 is in the retracted and locked position. In this position, the top edges 36 and 60 are level with each other and we will assume that the shelf 16 is connected at its side edge to the sliding bracket 14. The presence of second support 66 locked in second rest 76 keeps the shelf from being pulled out. In FIG. 6B, front 30 of sliding bracket 14 has been raised so that second connecting support 66 is now in line with slot 50 proper. Sliding bracket 14 can be pulled straight out in the direction of the arrow. As it slides out, first connecting support 64 slides up the angled portion of first rest 74 and simultaneously slides along slot 40 as slot 50 slides past the second connecting support 66 until the position of FIG. 6C is reached. At this point, the sliding movement is arrested by the presence of first connecting support 64 which has slid to outer end 42 of slot 40. Simultaneously, slot 50 has been slid out past second connecting support 66 until the inner end 54 of slot 50 is in contact with connecting support 66 which is in preparation to enter arcuate slot 70.

Arcuate slot 70 is preferably formed on a radius from the center of first connecting support 64 such that bracket 14 acts like it's hinged at support 64 and without interference smoothly pivots to the position of FIG. 6D, until the end 46 is lowered and tilled at a downward angle. First connecting support 64 acts as a stop which stops the outward movement of sliding bracket 14 and also acts as a pivot which allows sliding bracket 14 to pivot around point 64 while the second connecting support 66 is simultaneously moving into slot 70. When connector 66 reaches the end of slot 70, downwardly pivoting movement of sliding bracket 14 is arrested and the interaction of the first and second connecting supports 64, 66 with the ends of the respective slots 40, 70 prevents any further tilting so that sliding bracket 14 is held in angled position. It can be seen that the pivoting action locks the sliding bracket 14 in the position of FIG. 6D and it will not slide back until the end 46 is physically raised up so that second connecting support 66 comes out of slot 70 back into slot 50. Then sliding bracket 14 can be returned to the position of FIG. 6A by reversing the process.

Figure 7:
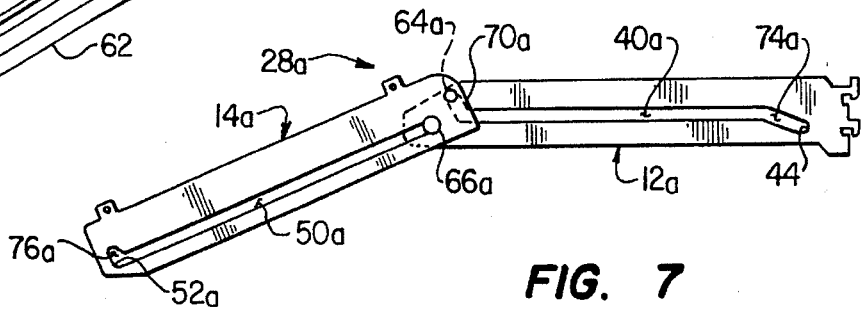
FIG. 7 shows an alternate design in which the arcuate slot is located in the front portion of the stationary bracket rather than in the rear portion of the sliding bracket.

In the alternative of FIG. 7, we have the same parts indicated by subscript but the arcuate slot 70 which is shown as **70*a* is located near the outer end of stationary bracket 12*a*. Although the vertical positioning of the slots 40*a*, 50*a* with respect to each other is altered to allow enough room to provide the upwardly angled slot 70*a* at the outer end of the fixed bracket 12***a*, otherwise the parts are essentially the same. In this case, when the sliding bracket 14*a* is pulled out, the second connecting support 66*a* serves as a stop which prevents further extension of sliding bracket 14*a* and serves as a pivot to allow sliding bracket 14*a* to pivot downwardly such that the first connecting support 64*a* mounted in the rear of sliding bracket 14*a* is disposed in arcuate slot 70*a* located at the outer end of stationary bracket 12*a*. The same first rest 74*a* and second rest 76*a* may be employed to insure level retracted position and permit universal bracket 28 to be locked in the retracted position via second rest 76*a* being passed over the stem of second connecting support 66*a*. The movement from the downwardly angled extended position of FIG. 7 back to the retracted position is, of course, produced by reversing the steps.

The brackets of the present invention are preferably stamped from flat stock about 1/16 inches thick. Sequential forming steps can produce the finished bracket very economically with respect to labor and material. The connecting supports are fasteners which can be fixed in place into threaded openings, with nuts, for example, or could be welded or brazed in place. The typical length of the brackets would be 1 ½ to 2 feet for conventional grocery shelves and the extension would be nearly the same amount. The brackets could be used with or without the strengthening elements and lateral formations formed therein, depending on the desired strength and resistance to bending.

I claim:

1. A universal support bracket suitable to support each lateral side of a grocery shelf which can be pulled out, pivoted down at an angle and held in a downwardly angled position in order to load fresh material behind the already shelved material without unloading the shelf, comprising:

an elongated stationary bracket having a front, a back and generally flat sides defining top and bottom edges, the back having formations for engaging supports at the rear of the stationary bracket capable of holding the stationary bracket in a horizontal orientation with the sides vertical;

an elongated slot in the stationary bracket extending longitudinally from front to back along its length and having outer and inner ends;

an elongated sliding bracket having a front, a back and generally flat sides defining top and bottom edges, said sliding bracket arranged as a companion to the stationary bracket in side by side relation;

an elongated slot in the sliding bracket extending longitudinally from front to back along its length and having outer and inner ends;

a first headed connector fixed near the back of the sliding bracket which slides in the elongated slot in the stationary bracket and a second headed connector fixed near the front of the stationary bracket which slides in the elongated slot in the sliding bracket, said first and second connectors holding said brackets in close sliding side by side relation whereby said sliding bracket can be moved longitudinally with respect to the stationary bracket between a retracted and an extended position;

one of said elongated slots of one of said brackets having a short arcuate slot at its end extending toward the top edge wherein one of said first or second headed connectors serves as a stop and pivot for the sliding bracket in the extended position while the other of said first or second headed connectors follows the arcuate slot when the sliding bracket is pulled out to the extended position, pivoted downwardly and supported in a downwardly angled position by said other of said first or second headed connectors; and said universal support bracket will support either side edge of a grocery shelf by attaching each lateral side of said grocery shelf to an elongated sliding bracket of a universal support bracket whereby said shelf can be pulled out to the extended position, pivoted downwardly and supported in a downwardly angled position.

2. The universal support bracket of claim 1 characterized in that the short arcuate slot is located on a radius determined by the distance between said first and second headed connectors when the sliding bracket is pulled out to the extended position.

3. The universal support bracket of claim 2 characterized in that said short arcuate slot is located at the inner end of said sliding bracket and said second headed connector serves as said stop and pivot while said first headed connector follows said arcuate slot.

4. The universal support bracket of claim 2 characterized in that said short arcuate slot is located at the outer end of said stationary bracket and said first headed connector serves as said stop and pivot while said second headed connector follows said arcuate slot.

5. The universal support bracket of claim 2 characterized in that said elongated slots are arranged in vertically offset generally parallel relation.

6. The universal support bracket of claim 2 wherein the outer end of the elongated slot in the sliding bracket comprises a second rest which turns toward the top edge, said second rest receiving the second headed connector when the sliding bracket is in the retracted position whereby said sliding bracket is releasably held in the retracted position.

7. The universal support bracket of claim 6 wherein the inner end of the elongated slot in the stationary bracket comprises a first rest which turns away from the top edge and receives the first connecting support while said second rest receives said second connecting support when the sliding bracket is in the retracted position, said rests being positioned such that the top edges remain approximately parallel.

8. The universal support bracket of claim 7 characterized in that said sliding bracket includes means for attachment to the side edge of a grocery shelf and said universal support bracket can be employed equally well as a left or right shelf support.

9. A pull-out drop down grocery shelf assembly having a pair of universal support brackets suitable for attachment on both sides of a shelf so that the shelf can be pulled out, pivoted down at an angle and supported in a downwardly angled position by said universal support brackets in order to load fresh material behind the already shelved material without unloading the shelf, comprising:

a rectangular grocery shelf having sides, front and back and a flat surface for holding grocery products;

a pair of universal support brackets having a length approximately the same as the side of the shelf, one for each side, each universal support bracket including:

an elongated stationary bracket having a front, a back and generally flat sides defining top and bottom edges, the back having formations for engaging supports at the rear of the stationary bracket capable of holding the stationary bracket in horizontal orientation with the sides vertical, said stationary bracket having an elongated slot extending longitudinally from front to back along its length, said slot having an outer end and an inner end respectively, an elongated sliding bracket having a front, a back and generally flat sides defining top and bottom edges, said sliding bracket arranged as a companion to the stationary bracket in sliding side by side relation, said sliding bracket having an elongated slot extending longitudinally from front to back along its length, said slot having an outer end and an inner end respectively, each universal support bracket having a first connector fixed near the back of the sliding bracket which slides in the elongated slot in the stationary bracket and a second connector fixed near the front of the fixed bracket which slides in the elongated slot in the sliding bracket, said first and second connectors holding said brackets in sliding side by side relation whereby said sliding bracket can be moved longitudinally with respect to the stationary bracket between a retracted and an extended position;

means for connecting each side of the shelf to one of the sliding brackets;

means associated with an end of one of said elongated slots in each universal support bracket to allow said shelf and the sliding bracket on each side to be pulled out to its extended position along with said shelf, pivoted downwardly and supported at an angle with respect to the stationary brackets on each side;

said means associated with an end of one of said elongated slots in each universal support bracket comprises one of said elongated slots of one of said brackets having a short slot at its outer end extending toward the top edge wherein one of said first or second connectors serves as a stop and pivot for the sliding bracket in the extended position while the other of said first or second connectors follows the slot when the shelf and sliding brackets are pulled out to the extended position, pivoted downwardly and supported in a downwardly angled position by the other of said first or second connectors;

whereby already stocked products on the shelf can be pulled forward for restocking and the shelf and sliding brackets raised and slid back to the retracted position without the necessity of unloading the shelf.

10. The pull-out drop down grocery shelf assembly of claim 9 characterized in the said elongated slots are arranged in vertically offset parallel relation.

11. The pull-out drop down grocery shelf assembly of claim 9 characterized in that said short slot is located on a radius determined by the distance between said first and second connectors when the sliding bracket is pulled out to the extended position.

12. The pull-out drop down grocery shelf assembly of claim 11 characterized in that said elongated slots are arranged in vertically offset generally parallel relation.

13. The pull-out drop down grocery shelf assembly of claim 11 characterized in that the outer end of the elongated slot in the sliding bracket turns toward the top edge to comprise a second rest, said second rest receiving the second connector when the sliding bracket is in the retracted position whereby said sliding bracket is releasably held in the retracted position.

14. The pull-out drop down grocery shelf assembly of claim 13 characterized in that the inner end of the elongated slot in the stationary bracket turns away from the top edge to comprise a first rest and receives the first connector while said second rest receives said second connector when the sliding bracket is in the retracted position, said rests being positioned such that the top edges of the stationary and sliding brackets remain approximately parallel.

15. The pull-out drop down grocery shelf assembly of claim 14 wherein the back of the shelf includes a laterally extending vertically raised barrier which helps hold products on the shelf.

16. The pull-out drop down shelf assembly of claim 14 characterized in that the assembly includes a removable fence, which can be positioned just prior to pulling the shelf to the extended position and pivoting the shelf downwardly, to help hold older products which are pulled forward by the delivery man in order to place fresh products on the shelf.

* * * * *